US006866503B2

(12) United States Patent
Ladharam

(10) Patent No.: US 6,866,503 B2
(45) Date of Patent: Mar. 15, 2005

(54) SLOTTED INJECTION NOZZLE AND LOW $NO_X$ BURNER ASSEMBLY

(75) Inventor: Mahendra Ladharam, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 0 days.

(21) Appl. No.: 10/353,683

(22) Filed: Jan. 29, 2003

(65) Prior Publication Data

US 2004/0146821 A1 Jul. 29, 2004

(51) Int. Cl.[7] ..... F23C 5/00

(52) U.S. Cl. ..... 431/10; 431/181; 431/187; 431/350; 431/353

(58) Field of Search ..... 431/10, 353, 187, 431/181, 350, 349; 239/601

(56) References Cited

U.S. PATENT DOCUMENTS

| | | | | |
|---|---|---|---|---|
| 2,121,948 A | * | 6/1938 | Borland | 431/349 |
| 2,959,361 A | * | 11/1960 | Stanislaw | 239/568 |
| 4,790,485 A | | 12/1988 | Yamamoto | |
| 4,813,867 A | * | 3/1989 | Yoshida et al. | 431/353 |
| 5,058,703 A | | 10/1991 | Ealba et al. | 181/228 |
| 5,195,884 A | * | 3/1993 | Schwartz et al. | 431/8 |
| 5,269,678 A | | 12/1993 | Schwartz et al. | |
| 5,275,554 A | * | 1/1994 | Faulkner | 431/115 |
| 5,402,567 A | * | 4/1995 | Riehl | 29/890.01 |
| 5,575,637 A | | 11/1996 | Slavejkov et al. | 431/8 |
| 5,611,682 A | | 3/1997 | Slavejkov et al. | 431/8 |
| 5,634,785 A | | 6/1997 | Bury et al. | |
| 5,664,733 A | | 9/1997 | Lott | 239/429 |
| 5,775,446 A | | 7/1998 | Lott | 239/429 |
| 5,884,472 A | | 3/1999 | Presz, Jr. et al. | 60/262 |
| 5,924,632 A | | 7/1999 | Seiner et al. | 239/265.19 |
| 5,992,763 A | | 11/1999 | Smith et al. | 239/428.5 |
| 6,036,481 A | | 3/2000 | Legutko et al. | |
| 6,082,635 A | | 7/2000 | Seiner et al. | 239/265.19 |
| 6,338,439 B1 | | 1/2002 | Goenka et al. | 239/8 |
| 6,360,528 B1 | | 3/2002 | Brausch et al. | 60/262 |

FOREIGN PATENT DOCUMENTS

| | | |
|---|---|---|
| BE | 442 980 A | 11/1941 |
| DE | 94 03 330 U | 4/1994 |
| FR | 2 317 592 A | 2/1977 |
| FR | 2 374 590 | 7/1978 |
| GB | 1 376 395 | 12/1974 |

OTHER PUBLICATIONS

U.S. Appl. No. 10/067,450, filed Jan. 31, 2002, Joshi et al.
U.S. Appl. No. 10/062,597, filed Jan. 31, 2002, Heier et al.
Website data sheet, http://www.vortexventures.com, "Lobe-star Mixing Nozzles".

* cited by examiner

*Primary Examiner*—Jiping Lu
(74) *Attorney, Agent, or Firm*—Keith D. Gourley

(57) ABSTRACT

A nozzle comprising a nozzle body having an inlet face, an outlet face, and an inlet flow axis passing through the inlet and outlet faces, and two or more slots extending through the nozzle body from the inlet face to the outlet face. Each slot has a slot axis and the slot axis of at least one of the slots is not parallel to the inlet flow axis of the nozzle body. In another embodiment, the nozzle comprises a nozzle body having an inlet face, an outlet face, and an inlet flow axis passing through the inlet and outlet faces, and two or more slots extending through the nozzle body from the inlet face to the outlet face, each slot having a slot axis, wherein none of the slots intersect other slots and all of the slots are in fluid flow communication with a common fluid supply conduit. The nozzles may be used to inject secondary fuel in a burner system having a central burner combusting a primary fuel surrounded by secondary fuel injection nozzles.

14 Claims, 12 Drawing Sheets

SLOTTED INJECTION NOZZLE AND LOW $NO_x$ BURNER ASSEMBLY

BACKGROUND OF THE INVENTION

Nozzles are used in a wide variety of applications to inject one fluid into another fluid and promote efficient mixing of the two fluids. Such applications include, for example, chemical reactor systems, industrial burners in process furnaces, fuel injectors in gas turbine combustors, jet engine exhaust nozzles, fuel injectors in internal combustion engines, and chemical or gas injection in wastewater treatment systems. The objective in these applications is to promote vortical mixing and rapid dispersion of the injected fluid into the surrounding fluid. It is usually desirable to achieve this efficient mixing with a minimum pressure drop of the injected fluid.

The proper design of injection nozzles for burners in industrial furnaces and boilers is important for maximizing combustion efficiency and minimizing the emissions of carbon monoxide and oxides of nitrogen ($NO_x$). In particular, tightening regulations on $NO_x$ emissions will require improved and highly efficient nozzle and burner designs for all types of fuels used in industrial furnaces and boilers. Burners in these combustion applications utilize fuels such as natural gas, propane, hydrogen, refinery offgas, and other fuel gas combinations of varying calorific values. Air, preheated air, gas turbine exhaust, and/or oxygen-enriched air can be used as oxidants in the burners.

Conventional turbulent jets can be used in a circular nozzle tip to entrain secondary or surrounding combustion gases in a furnace by a typical jet entrainment process. The entrainment efficiency can be affected by many variables including the primary fuel and oxidant injection velocity or supply pressure, secondary or surrounding fluid flow velocity, gas buoyancy, primary and secondary fluid density ratio, and the fuel nozzle design geometry. Efficient low $NO_x$ burner designs require nozzle tip geometries that yield maximum entrainment efficiency at a given firing rate or at given fuel and oxidant supply pressures. Higher entrainment of furnace gases followed by rapid mixing between fuel, oxidant gas, and furnace gases produce lower average flame temperatures, which reduce thermal $NO_x$ formation rates. Enhanced mixing in the furnace space also can reduce CO levels in the flue gas. If the nozzle design geometry is not optimized, the nozzle may require much higher fuel and/or oxidant supply pressures or higher average gas velocities to achieve proper mixing in the furnace and yield the required $NO_x$ emission levels.

In many processes in the chemical industry, the fuel supply pressure is limited due to upstream or downstream processes. For example, in the production of hydrogen or synthesis gas from natural gas by steam methane reforming (SMR), a reformer reactor furnace fired by a primary natural gas fuel produces a raw synthesis gas stream. After optional water gas shift to maximize conversion to hydrogen, a pressure swing adsorption (PSA) system is used to recover the desired product from the reformer outlet gas. Combustible waste gas from the PSA system, which typically is recovered at a low pressure, is recycled to the reformer as additional or secondary fuel. High product recovery and separation efficiency in a PSA system requires that blowdown and purge steps occur at pressures approaching atmospheric, and typically these pressures are as low as practical to maximize product recovery. Therefore, most PSA systems typically produce a waste gas stream at 5 to 8 psig for recycle to the reformer furnace. After a surge tank to even out cyclic pressure fluctuations and necessary flow control equipment for firing control, the waste gas supply pressure available for secondary fuel to the reformer furnace burners may be less than 3 psig.

For cost-effective control of $NO_x$ emissions from SMR process furnaces, the burners should be capable of firing at these low secondary fuel supply pressures. If the burners cannot operate at these low pressures, the secondary fuel must be compressed, typically using electrically-driven compressors. For large hydrogen plants, the cost of this compression can be a significant portion of the overall operating cost, and it is therefore desirable to operate the reformer furnace burners directly on low-pressure PSA waste gas as the secondary fuel.

Some commercially-available low $NO_x$ burners use active mixing control methods such as motor-driven vibrating nozzle flaps or solenoid-driven oscillating valves to produce fuel-rich and/or fuel-lean oscillating combustion zones in the flame region. In these burners, external energy is used to increase turbulent intensity of the fuel and oxidant jets to improve mixing rates. However, these methods cannot be used in all low $NO_x$ burner designs or heating applications because of furnace space and flame envelope considerations. Other common $NO_x$ control methods include dilution of fuel gas with recirculated flue gas or the injection of steam. By injecting non-reactive or inert chemical species in the fuel-oxidant mixture, the average flame temperature is reduced and thus $NO_x$ emissions are reduced. However, these methods require additional piping and costs associated with transport of flue gas, steam, or other inert gases. In addition, there is an energy penalty due to the required heating of dilution gases from ambient temperature to the process temperature.

It is desirable that new low $NO_x$ burner designs utilize cost-effective passive mixing techniques to improve process economics. Such passive techniques utilize internal fluid energy to enhance mixing and require no devices that use external energy. In addition, new low $NO_x$ burners should be designed to operate at very low fuel gas pressures. Embodiments of the present invention, which are described below and defined by the claims which follow, present improved nozzle and burner designs which reduce $NO_x$ emissions to very low levels while allowing the use of very low pressure fuel gas.

BRIEF SUMMARY OF THE INVENTION

In one of several embodiments, the invention is a nozzle comprising a nozzle body having an inlet face, an outlet face, and an inlet flow axis passing through the inlet and outlet faces, and two or more slots extending through the nozzle body from the inlet face to the outlet face, each slot having a slot axis. The slot axis of at least one of the slots is not parallel to the inlet flow axis of the nozzle body. The nozzle may further comprise a nozzle inlet pipe having a first end and a second end, wherein the first end is attached to and in fluid flow communication with the inlet face of the nozzle body. The slot axes of at least two slots in the nozzle may not be parallel to each other. The ratio of the axial slot length to the slot height may be between about 1 and about 20.

At least two of the slots in the nozzle may intersect each other. The nozzle may have three or more slots and one of the slots may be intersected by each of the other slots. In one configuration, the nozzle has four slots wherein a first and a second slot intersect each other and a third and a fourth slot intersect each other.

Another embodiment of the invention is a nozzle comprising a nozzle body having an inlet face, an outlet face, and an inlet flow axis passing through the inlet and outlet faces, and two or more slots extending through the nozzle body from the inlet face to the outlet face, each slot having a slot axis and a slot center plane. None of the slots intersect other slots and all of the slots are in fluid flow communication with a common fluid supply conduit. The center plane of at least one slot may intersect the inlet flow axis.

An alternative embodiment of the invention is a nozzle comprising a nozzle body having an inlet face, an outlet face, and an inlet flow axis passing through the inlet and outlet faces, and two or more slots extending through the nozzle body from the inlet face to the outlet face, each slot having a slot axis and a slot center plane. A first slot of the two or more slots may be intersected by each of the other slots and the slot center plane of at least one of the slots may intersect the inlet flow axis of the nozzle body. The center plane of the first slot may intersect the inlet flow axis at an included angle of between 0 and about 30 degrees. The center plane of any of the other slots may intersect the inlet flow axis at an included angle of between 0 and about 30 degrees. The center planes of two adjacent other slots may intersect at an included angle of between 0 and about 15 degrees. The two adjacent other slots may intersect at the inlet face of the nozzle body.

The invention includes a burner assembly comprising:

(a) a central flame holder having inlet means for an oxidant gas, inlet means for a primary fuel, a combustion region for combusting the oxidant gas and the primary fuel, and an outlet for discharging a primary effluent from the flame holder; and (b) a plurality of secondary fuel injector nozzles surrounding the outlet of the central flame holder, wherein each secondary fuel injector nozzle comprises (1) a nozzle body having an inlet face, an outlet face, and an inlet flow axis passing through the inlet and outlet faces; and (2) one or more slots extending through the nozzle body from the inlet face to the outlet face, each slot having a slot axis and a slot center plane.

Each secondary fuel injector nozzle of the burner assembly may have two or more slots and the slot axes of at least two slots may not be parallel to each other. Each secondary fuel injector nozzle may have two or more slots and at least two of the slots may intersect each other. The nozzle body may have four slots, wherein a first and a second slot intersect each other, and wherein a third and a fourth slot intersect each other.

Alternatively, the nozzle body may have three or more slots and a first slot may be intersected by each of the other slots. The center plane of the first slot may intersect the inlet flow axis at an included angle of between 0 and about 15 degrees. The center plane of any of the other slots may intersect the inlet flow axis at an included angle of between 0 and about 30 degrees. The center planes of two adjacent other slots may intersect at an included angle of between 0 and about 15 degrees. The two adjacent slots may intersect at the inlet face of the nozzle body.

The invention also includes a combustion process comprising:

(a) providing burner assembly including:

(1) a central flame holder having inlet means for an oxidant gas, inlet means for a primary fuel, a combustion region for combusting the oxidant gas and the primary fuel, and an outlet for discharging a primary effluent from the flame holder; and (2) a plurality of secondary fuel injector nozzles surrounding the outlet of the central flame holder, wherein each secondary fuel injector nozzle comprises (2a) a nozzle body having an inlet face, an outlet face, and an inlet flow axis passing through the inlet and outlet faces; and (2b) one or more slots extending through the nozzle body from the inlet face to the outlet face, each slot having a slot axis and a slot center plane;

(b) introducing the primary fuel and the oxidant gas into the central flame holder, combusting the primary fuel with a portion of the oxidant gas in the combustion region of the flame holder, and discharging a primary effluent containing combustion products and excess oxidant gas from the outlet of the flame holder; and (c) injecting the secondary fuel through the secondary fuel injector nozzles into the primary effluent from the outlet of the flame holder and combusting the secondary fuel with excess oxidant gas.

The primary fuel and the secondary fuel may be gases having different compositions. In one embodiment, the primary fuel may be natural gas and the secondary fuel may comprise hydrogen, methane, carbon monoxide, and carbon dioxide obtained from a pressure swing adsorption system. The secondary fuel may be introduced into the secondary fuel injector nozzles at a pressure of less than about 3 psig. The primary fuel and the secondary fuel may be gases having the same compositions.

BRIEF DESCRIPTION OF SEVERAL VIEWS OF THE DRAWINGS

Embodiments of the present invention are illustrated by the following drawings, which are not necessarily to scale.

DETAILED DESCRIPTION OF THE INVENTION

Various embodiments of the present invention include a nozzle or fluid injection device for the introduction of a primary fluid into a secondary fluid to promote the efficient mixing of the two fluids. Embodiments of the nozzle are characterized by the use of oriented slots for injecting the primary fluid and promoting rapid vortical mixing with the secondary fluid by flow-induced downstream instabilities and a high level of small-scale and molecular mixing between the two fluids. The mixing may be achieved rapidly in a short axial distance from the nozzle outlet. Embodiments of the nozzle may be used in numerous applications including, for example, chemical reactor systems, industrial burners in process furnaces, fuel injectors in gas turbine combustors, jet engine exhaust nozzles, fuel injectors in internal combustion engines, and chemical or gas injection in wastewater treatment systems. The nozzles are particularly useful for the rapid mixing of fuel, oxidant, and combustion gases in process furnaces, boilers, and other combustion systems.

Figure 1:
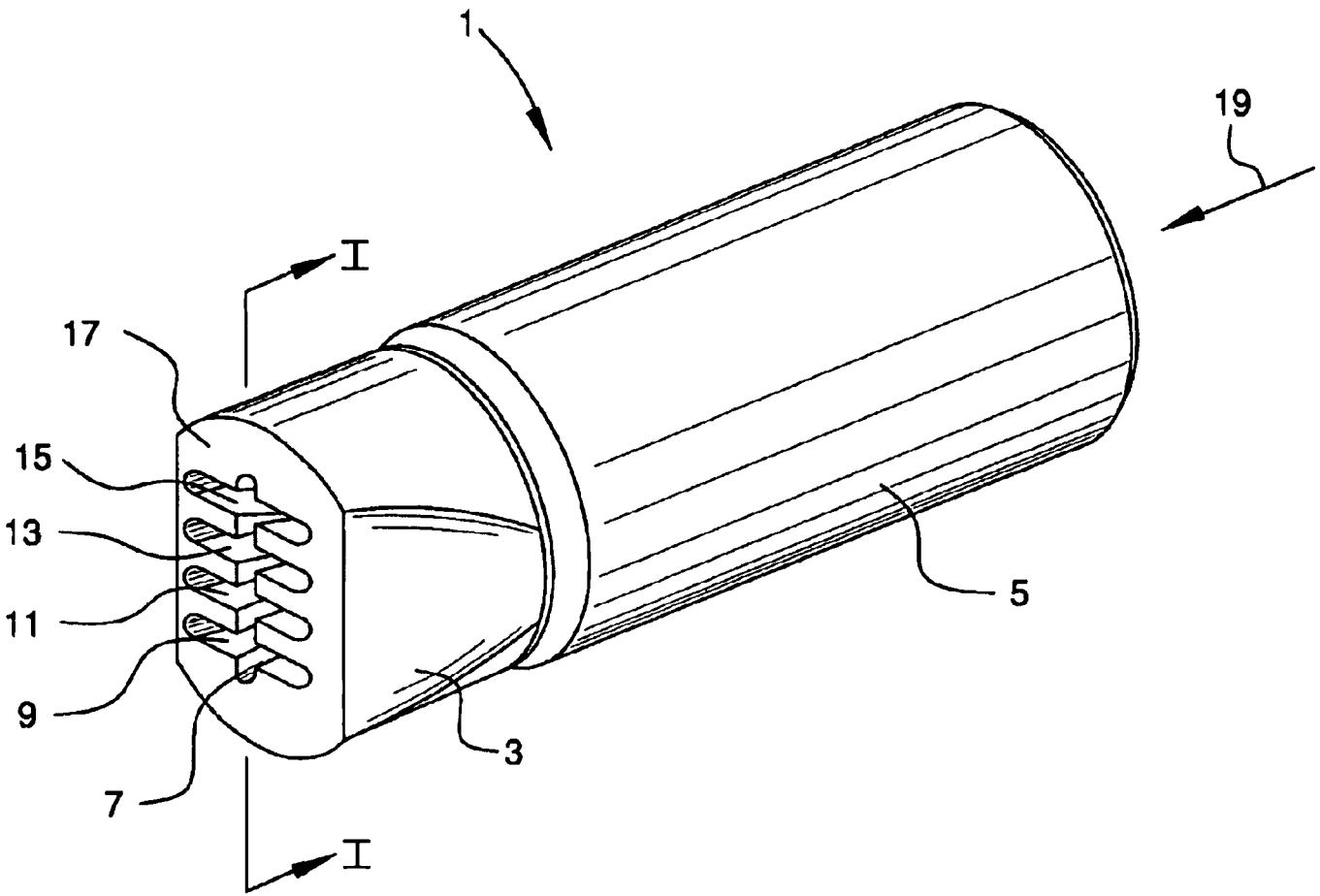
FIG. 1 is an isometric view of a nozzle assembly and nozzle body according to an embodiment of the present invention.

An exemplary embodiment of the invention is illustrated in FIG. 1. Nozzle assembly 1 comprises nozzle body 3 joined to nozzle inlet pipe 5. Slot 7, illustrated here as vertically-oriented, is intersected by slots 9, 11, 13, and 15. The slots are disposed between outlet face 17 and an inlet face (not seen) at the connection between nozzle body 3 and nozzle inlet pipe 5. Fluid 19 flows through nozzle inlet pipe 5 and through slots 7, 9, 11, 13, and 15, and then mixes with another fluid surrounding the slot outlets. In addition to the slot pattern shown in FIG. 1, other slot patterns are possible as described later; the nozzle assembly can be used in any orientation and is not limited to the generally horizontal orientation shown. When viewed in a direction perpendicular to outlet face 17, exemplary slots 9, 11, 13, and 15 intersect slot 7 at right angles. Other angles of intersection are possible between exemplary slots 9, 11, 13, and 15 and slot 7. When viewed in a direction perpendicular to outlet face 17, exemplary slots 9, 11, 13, and 15 are parallel to one another; however, other embodiments are possible in which one or more of these slots are not parallel to the remaining slots.

The term "slot" as used herein is defined as an opening through a nozzle body or other solid material wherein any slot cross-section (i.e., a section perpendicular to the inlet flow axis defined below) is non-circular and is charactertized by a major axis and a minor axis. The major axis is longer than the minor axis and the two axes are generally perpendicular. For example, the major cross-section axis of any slot in FIG. 1 extends between the two ends of the slot cross-section; the minor cross-section axis is perpendicular to the major axis and extends between the sides of the slot cross-section. The slot may have a cross-section of any non-circular shape and each cross-section may be characterized by a center point or centroid, where centroid has the usual geometric definition.

A slot may be further characterized by a slot axis defined as a straight line connecting the centroids of all slot cross-sections. In addition, a slot may be characterized or defined by a center plane which intersects the major cross-section axes of all slot cross-sections. Each slot cross-section may have perpendicular symmetry on either side of this center plane. The center plane extends beyond either end of the slot and may be used to define the slot orientation relative to the nozzle body inlet flow axis as described below.

Figure 2:
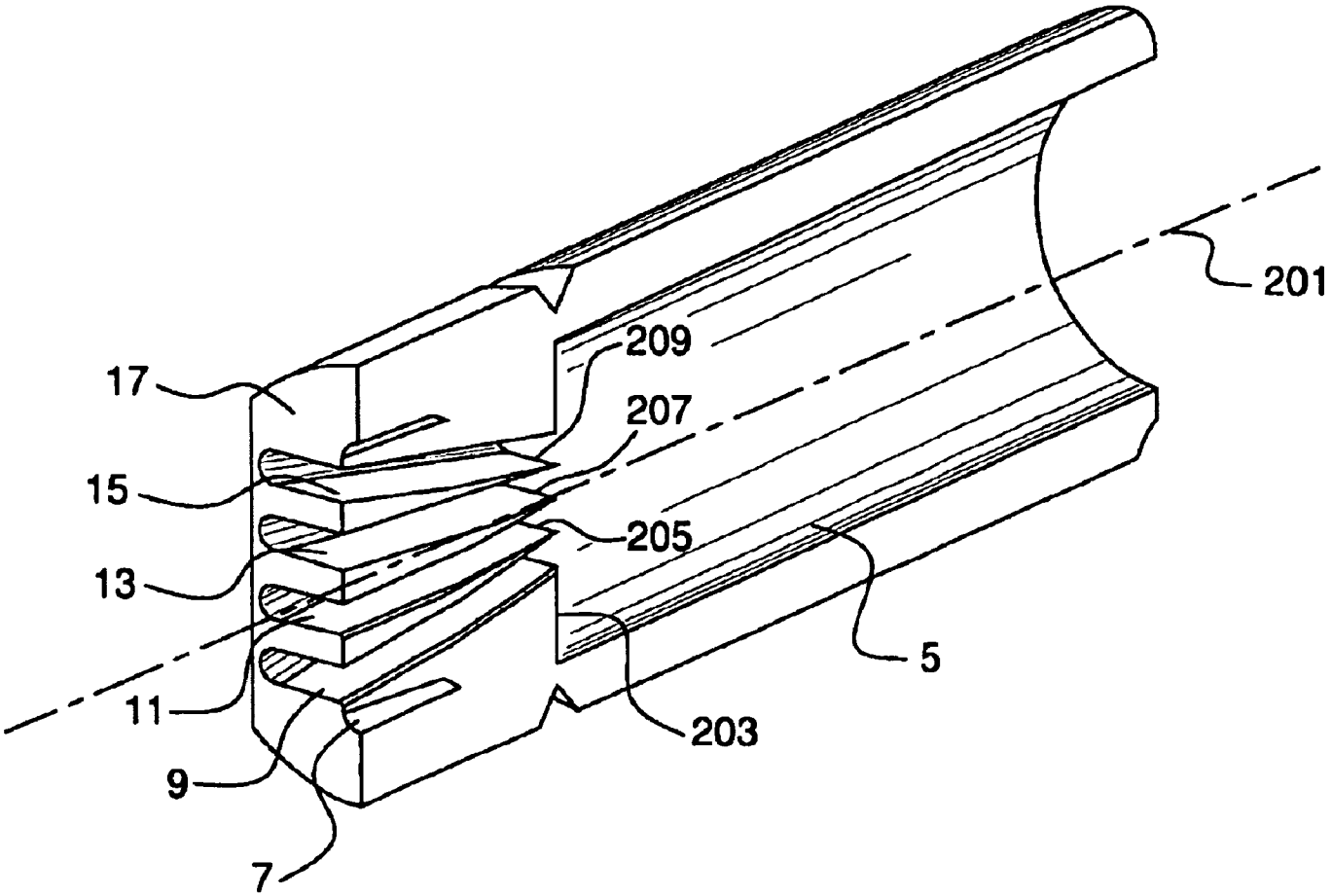
FIG. 2 is an axial section drawing of the nozzle body of FIG. 1.

Axial section I—I of the nozzle of FIG. 1 is given in FIG. 2. Inlet flow axis 201 passes through the center of nozzle inlet pipe 5, inlet face 203, and outlet face 17. In this embodiment, the center planes of slots 9, 11, 13, and 15 lie at angles to inlet flow axis 201 such that fluid flows from the slots at outlet face 17 in diverging directions from inlet flow axis 201. The center plane of slot 7 (only a portion of this slot is seen in FIG. 2) also lies at an angle to inlet flow axis 201. As will be seen later, this exemplary feature directs fluid from the nozzle outlet face in another diverging direction from inlet flow axis 201. In this exemplary embodiment, when viewed in a direction perpendicular to the axial section of FIG. 2, slots 9 and 11 intersect at inlet face 203 to form sharp edge 205, slots 11 and 13 intersect to form sharp edge 207, and slots 13 and 15 intersect to from sharp edge 209. These sharp edges provide aerodynamic flow separation to the slots and reduce pressure drop associated with bluff bodies. Alternatively, these slots may intersect at an axial location between inlet face 203 and outlet face 17, and the sharp edges would be formed within nozzle body 3. Alternatively, these slots may not intersect when viewed in a direction perpendicular to the axial section of FIG. 2, and no sharp edges would be formed.

The term "inlet flow axis" as used herein is an axis defined by the flow direction of fluid entering the nozzle at the inlet face, wherein this axis passes through the inlet and outlet faces. Typically, but not in all cases, the inlet flow axis is perpendicular to the center of nozzle inlet face 205 and/or outlet nozzle face 17, and meets the faces perpendicularly. When nozzle inlet pipe 5 is a typical cylindrical conduit as shown, the inlet flow axis may be parallel to or coincident with the conduit axis.

The axial slot length is defined as the length of a slot between the nozzle inlet face and outlet face, for example, between inlet face 203 and outlet face 17 of FIG. 2. The slot height is defined as the perpendicular distance between the slot walls at the minor cross-section axis. The ratio of the axial slot length to the slot height may be between about 1 and about 20.

The multiple slots in a nozzle body may intersect in a plane perpendicular to the inlet flow axis. As shown in FIG. 1, for example, slots 9, 11, 13, and 15 intersect slot 7 at right angles. If desired, these slots may intersect in a plane perpendicular to the inlet flow axis at angles other than right angles. Adjacent slots also may intersect when viewed in a plane parallel to the inlet flow axis, i.e., the section plane of FIG. 2. As shown in FIG. 2, for example, slots 9 and 11 intersect at inlet face 203 to form sharp edge 203 as earlier described. The angular relationships among the center planes of the slots, and also between the center plane of each slot and the inlet flow axis, may be varied as desired. This allows fluid to be discharged from the nozzle in any selected direction relative to the nozzle axis.

Figure 3A:
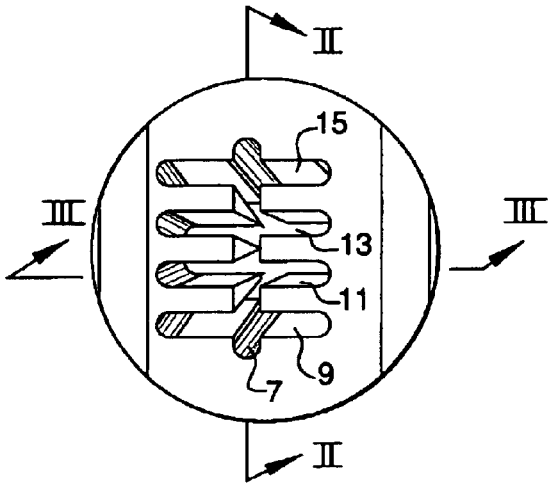
FIG. 3A is a front perspective view of the tip of the nozzle body of FIG. 1.
Figure 3C:
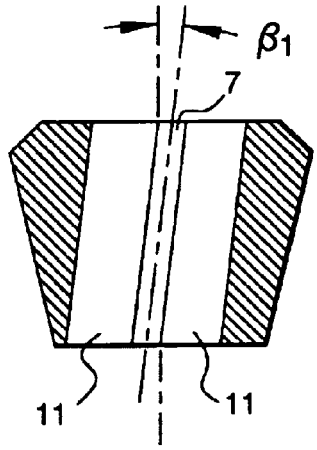
FIG. 3C is a side sectional view of the nozzle body of FIG. 1.
Figure 3B:
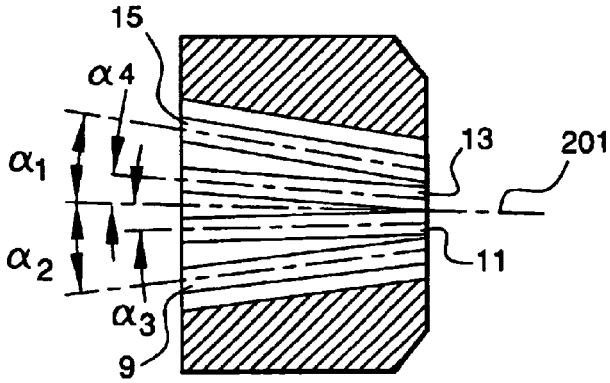
FIG. 3B is a top sectional view of the nozzle body of FIG. 1.

Additional views of exemplary nozzle body 3 are given in FIGS. 3A to 3D. FIG. 3A is a front perspective view of the nozzle body; FIG. 3B is a view of section II—II of FIG. 3A and illustrates the angles formed between the center planes of the slots and the inlet flow axis. Angle $\alpha_1$ is formed between the center plane of slot 15 and inlet flow axis 201 and angle $\alpha_2$ is formed between the center plane of slot 9 and inlet flow axis 201. Angles $\alpha_1$ and $\alpha_2$ may be the same or different, and may be in the range of 0 to about 30 degrees. Angle $\alpha_3$ is formed between the center plane of slot 11 and inlet flow axis 201 and angle $\alpha_4$ is formed between the center plane of slot 13 and inlet flow axis 201. Angles $\alpha_3$ and $\alpha_4$ may be the same or different, and may be in the range of 0 to about 30 degrees. The center planes of any two adjacent other slots may intersect at an included angle of between 0 and about 15 degrees.

FIG. 3C is a view of section III—III of FIG. 3A which illustrates the angle $\beta_1$ formed between the center plane of slot 7 and inlet flow axis 201. Angle $\beta_1$ may be in the range of 0 to about 30 degrees. The outer edges of slot 11 (as well as slots 9, 13, and 15) may be parallel to the center plane of slot 7.

Figure 3D:
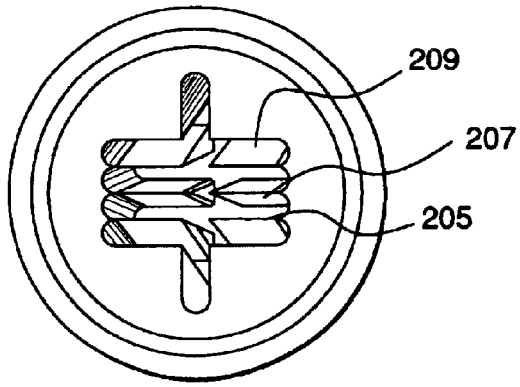
FIG. 3D is a rear view of the tip of the nozzle body of FIG. 1.

FIG. 3D is a rear perspective drawing of the nozzle body of FIG. 1 which gives another view of sharp edges 205, 207, and 209 formed by the intersections of slots 9, 11, 13, and 15.

Figure 4:
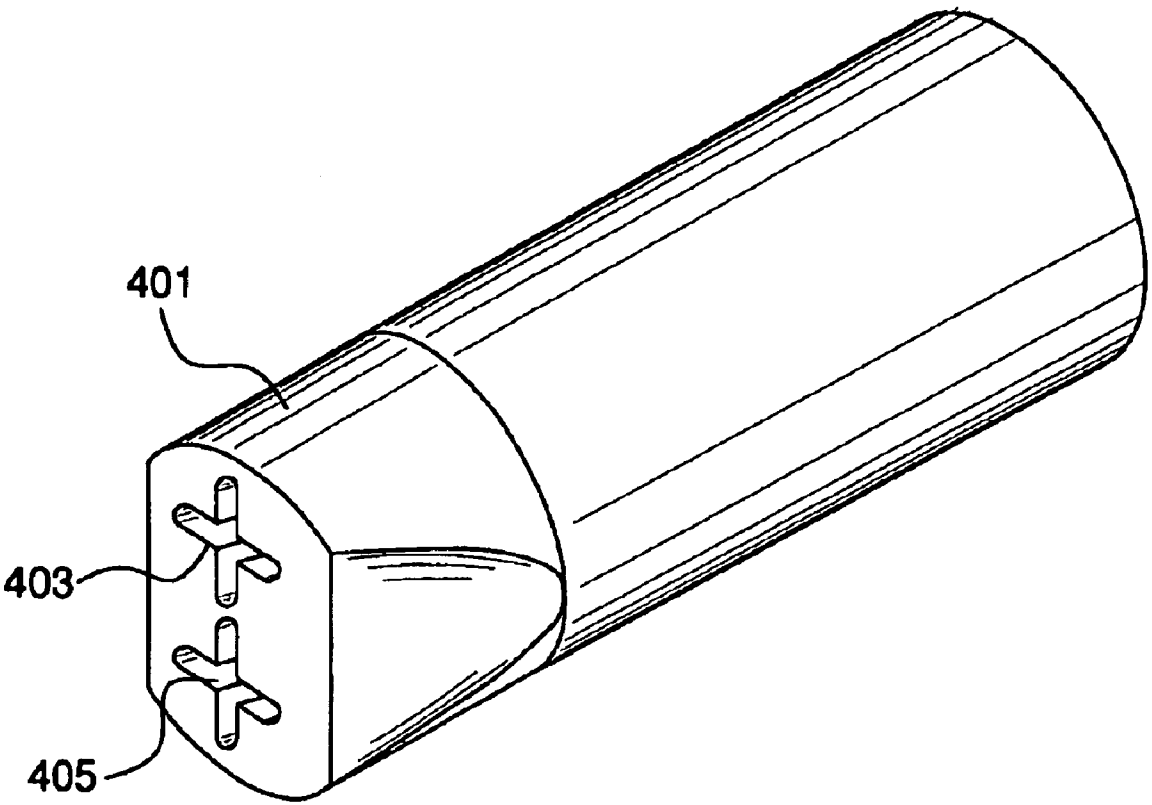
FIG. 4 is an isometric drawing of a nozzle assembly and nozzle body according to an alternative embodiment of the present invention.
Figure 5A:
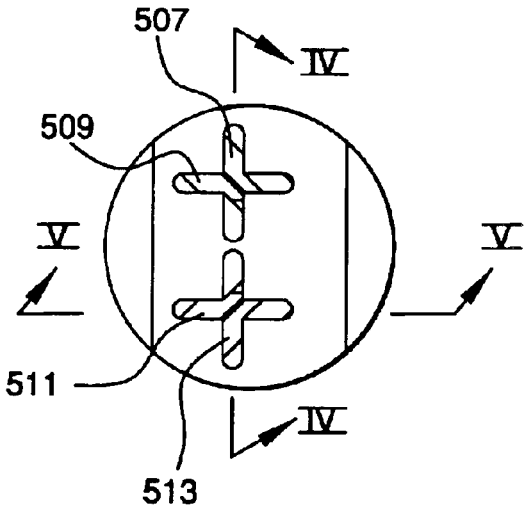
FIG. 5A is a front perspective view of the nozzle body of FIG. 5.

Another embodiment of the invention is illustrated in FIG. 4 in which the slots in nozzle body 401 are disposed in the form of two crosses 403 and 405. A front perspective view of the nozzle body is shown in FIG. 5A in which cross 403 is formed by slots 507 and 509 and cross 405 is formed by slots 511 and 513. A view of section IV—IV of FIG. 5A shows the center planes of slots 509 and 511 diverging from inlet flow axis 515 by angles $\alpha_5$ and $\alpha_6$. Angles $\alpha_5$ and $\alpha_6$ may be the same or different and may be in the range of 0 to about 30 degrees. The outer edges of slot 507 may be parallel to the center plane of slot 509 and the outer edges of slot 513 may be parallel to the center plane of slot 511. In this embodiment, slots 507 and 511 intersect to form sharp edge 512.

Figure 5B:
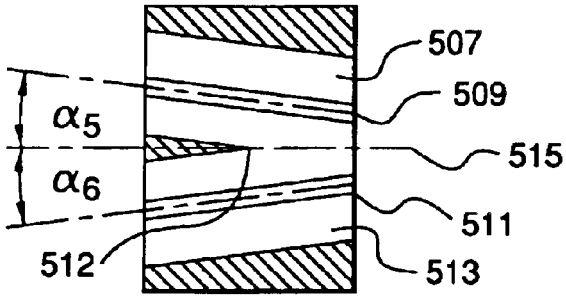
FIG. 5B is a side sectional view of the nozzle body of FIG. 5.
Figure 5C:
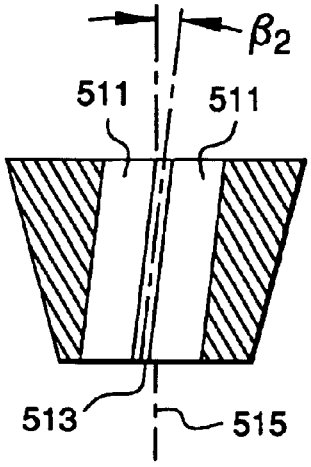
FIG. 5C is a top sectional view of the nozzle body of FIG. 5.

A view of section V—V of FIG. 5A is shown in FIG. 5C, which illustrates how the center plane of slot 513 diverges from inlet flow axis 515 by included angle $\beta_2$, which may be in the range of 0 to about 30 degrees. The outer edges of slot 511 may be parallel to the center plane of slot 513.

As described above, slots may intersect other slots in either or both of two configurations. First, slots may intersect when seen in a view perpendicular to the nozzle body outlet face (see, for example, FIG. 3A or 5A) or when seen in a slot cross-section (i.e., a section perpendicular to the inlet flow axis between the inlet face and outlet face). Second, adjacent slots may intersect when viewed in a section taken parallel to the inlet flow axis (see, for example, FIGS. 2, 3B, and 5B). An intersection of two slots occurs by definition when a plane tangent to a wall of a slot intersects a plane tangent to a wall of an adjacent slot such that the intersection of the two planes lies between the nozzle inlet face and outlet face, at the inlet face, and/or at the outlet face. For example, in FIG. 2, a plane tangent to a wall of slot 9 intersects a plane tangent to a wall of slot 7 and the intersection of the two planes lies between inlet face 203 and outlet face 17. A plane tangent to upper wall of slot 9 and a plane tangent to the lower wall of slot 11 intersect at edge 205 at inlet face 203. In another example, in FIG. 5B, a plane tangent to the upper wall of slot 513 and a plane tangent to the lower wall of slot 507 intersect at edge 512 between the two faces of the nozzle.

Each of the slots in the exemplary embodiments described above has generally planar and parallel internal walls. Other embodiments are possible in which the planar walls of a slot may converge or diverge relative to one another in the direction of fluid flow. In other embodiments, the slot walls may be curved rather than planar.

Figure 6A:
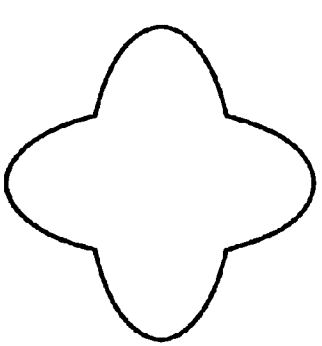
FIGS. 6A to 6F are schematic front views of several nozzle body embodiments of the present invention.
Figure 6B:
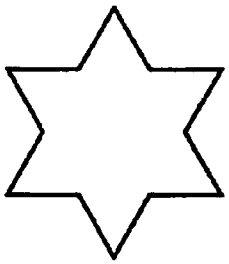
Figure 6C:
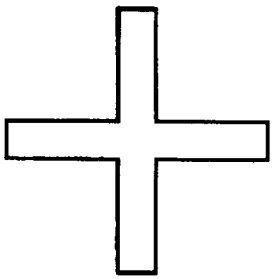
Figure 6D:
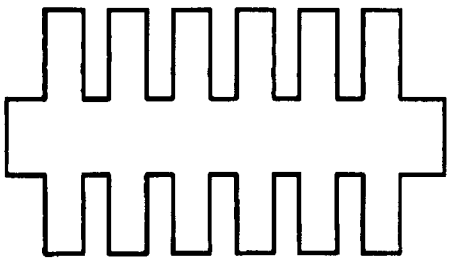
Figure 6E:
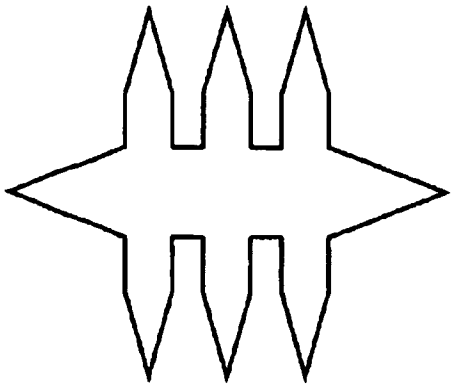
Figure 6F:
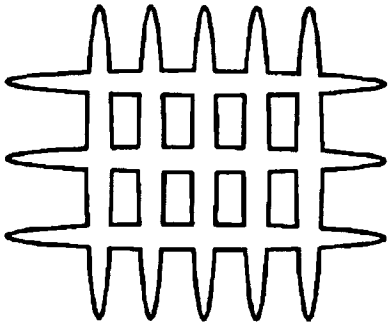
Figure 7A:
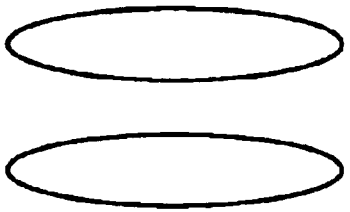
FIGS. 7A to 7F are schematic front views of alternative nozzle body embodiments of the present invention.
Figure 7B:
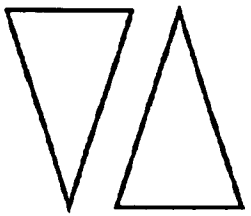
Figure 7C:
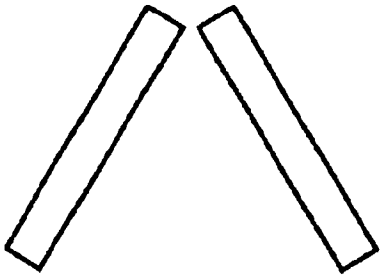
Figure 7D:
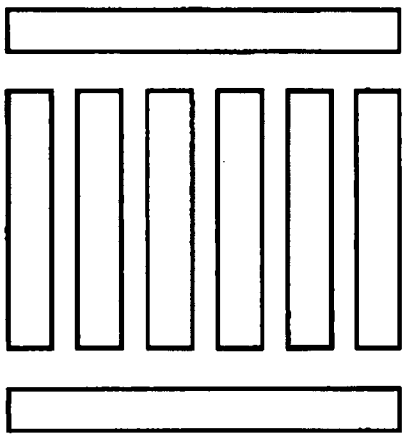
Figure 7E:
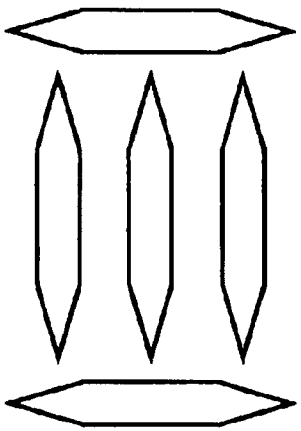
Figure 7F:
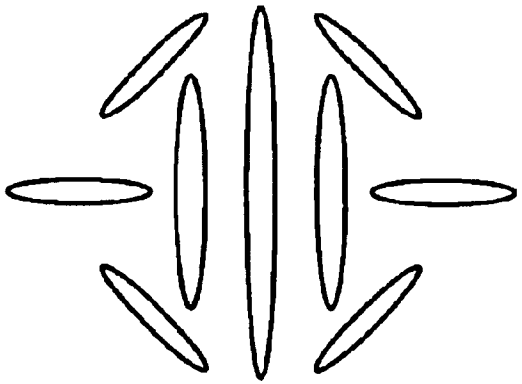

Each of the slots in the exemplary embodiments described above has a generally rectangular cross-section with straight sides and curved ends. Other embodiments using slots with other cross-sectional shapes are possible as illustrated in FIGS. 6A to 6F. FIGS. 6A, 6B, and 6C show exemplary configurations with intersecting slots having oval, triangular, and rectangular cross-sections, respectively, as seen in a front view of the outlet face of a nozzle body. FIGS. 6D, E, and F show exemplary configurations with multiple intersecting slots having rectangular, spike-shaped, and flattened oval shapes, respectively, as seen in a front view of the outlet face of a nozzle body.

Other configurations of intersecting slots can be envisioned which fall within the scope of the invention as long as each slot has a non-circular cross-section and can be characterized by a slot axis and a slot center plane as defined above. For example, two slots may intersect at the ends in a chevron-shaped or V-shaped configuration. Multiple slots may form multiple intersecting chevrons in a saw-toothed or zig-zag configuration.

In the embodiments described above with reference to FIGS. 1 to 6, the nozzle openings are formed by multiple slots that intersect when seen in a front view of the outlet face of the nozzle body (for example, see FIG. 3A). Alternative embodiments of the invention are possible in which multiple slots do not intersect when seen in a front view of the outlet face of the nozzle body. Several of these embodiments are illustrated by the nozzle body outlet face views of slots in FIGS. 7A through 7F, which show separate multiple slots having flattened oval, triangular, rectangular, and spike-shaped cross-sections. The center planes of one or more of these slots may be parallel to the nozzle body inlet flow axis; alternatively, the center planes of one or more of these slots may intersect the nozzle body inlet flow axis. Some of these slots may intersect one another when viewed in a section parallel to the inlet flow axis in a manner analogous to the slots of FIG. 3B. In the embodiments of FIGS. 7A to 7F, the fluid supply to all slots typically is provided from a common fluid supply conduit or plenum.

Many of the applications of the nozzles described above may utilize a nozzle body which is joined axially to a cylindrical pipe as illustrated in FIGS. 1 through 5. Other applications are possible, for example, in which multiple nozzle bodies are installed in the walls of a manifold or plenum which provides a common fluid supply to the nozzle bodies. It is also possible, and is considered an embodiment of the invention, to fabricate an integrated nozzle manifold or plenum in which the nozzle slots are cut directly into the manifold or plenum walls. In such an embodiment, the role of the nozzle bodies as described above would be provided by the section of manifold wall surrounding a group of slots which forms an individual nozzle.

The slotted nozzles described above provide a high degree of mixing utilizing novel nozzle tip geometries having multiple or intersecting slots which create intense three-dimensional axial and circumferential vortices or vortical structures. The interaction of these vorticies with jet instabilities causes rapid mixing between the primary and secondary fluids. Mixing can be achieved at relatively low injected fluid pressure drop and can be completed in a relatively short axial distance from the nozzle discharge. The use of these slotted nozzles provides an alternative to active mixing control methods such as boosting the fluid supply pressure or using motor driven vibratory nozzle flaps or solenoid-driven oscillating valves to promote mixing of the injected primary fluid with the surrounding secondary fluid.

The slotted nozzles described above may be fabricated from metals or other materials appropriate for the anticipated temperature and reactive atmosphere in each application. When used in combustion applications, for example, the slotted nozzles can be made of type 304 or 316 stainless steel.

The slotted nozzles described above may be used in combustion systems for the injection of fuel into combustion gases with high mixing efficiency. A sectional illustration of an exemplary burner system using slotted nozzles is given in FIG. 8, which shows a central burner or flame holder surrounded by multiple slotted nozzles (which may be defined as staging nozzles) for injecting secondary fuel. Central burner or flame holder 801 comprises outer pipe 803, concentric intermediate pipe 805, and inner concentric pipe 807. The interior of inner pipe 807 and annular space 809 between outer pipe 803 and intermediate pipe 805 are in flow communication with the interior of outer pipe 803. Annular space 811 between inner pipe 807 and intermediate pipe 805 is connected to and in flow communication with fuel inlet pipe 813. The central burner is installed in furnace wall 814.

In the operation of this central burner, oxidant gas (typically air or oxygen-enriched air) 815 flows into the interior of outer pipe 803, a portion of this air flows through the interior of inner pipe 807, and the remaining portion of this air flows through annular space 809. Primary fuel 815 flows through pipe 813 and through annular space 811, and is combusted initially in combustion zone 817 with air from inner pipe 807. Combustion gases from combustion zone 817 mix with additional air in combustion zone 819. Combustion in this zone is typically extremely fuel-lean. A visible flame typically is formed in combustion zone 819 and in combustion zone 821 as combustion gases 823 enter furnace interior 825.

A secondary fuel system comprises inlet pipe 827, manifold 829, and a plurality of secondary fuel injection pipes 831. The ends of the secondary fuel injection pipes are fitted with slotted injection nozzles 833 similar to those described above, for example, in FIGS. 1–3. Secondary fuel 835 flows through inlet pipe 827, manifold 829, and secondary fuel injection pipes 831. Secondary fuel streams 837 from nozzles 833 mix rapidly and combust with the oxidant-containing combustion gases 823. Cooler combustion gases in furnace interior 825 are rapidly entrained by secondary fuel streams 837 by the intense mixing action promoted by slotted nozzles 833, and the secondary fuel is combusted with oxidant-containing combustion gases downstream of the exit of central burner 801. The primary fuel may be 5 to 30% of the total fuel flow rate (primary plus secondary) and the secondary fuel may be 70 to 95% of the total fuel flow rate.

Figure 8:
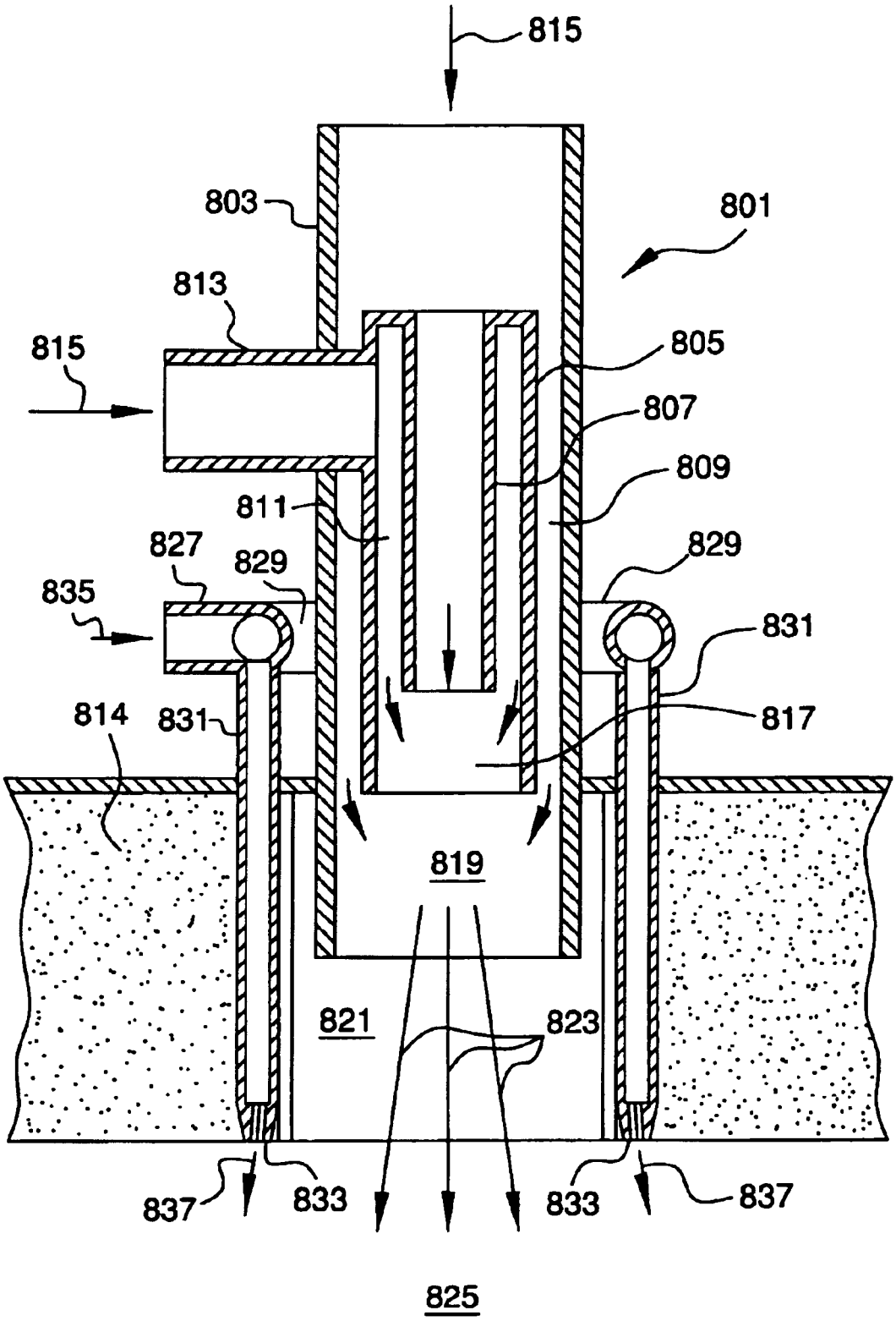
FIG. 8 is a schematic view of a burner assembly utilizing secondary nozzles according to an embodiment of the invention.
Figure 9:
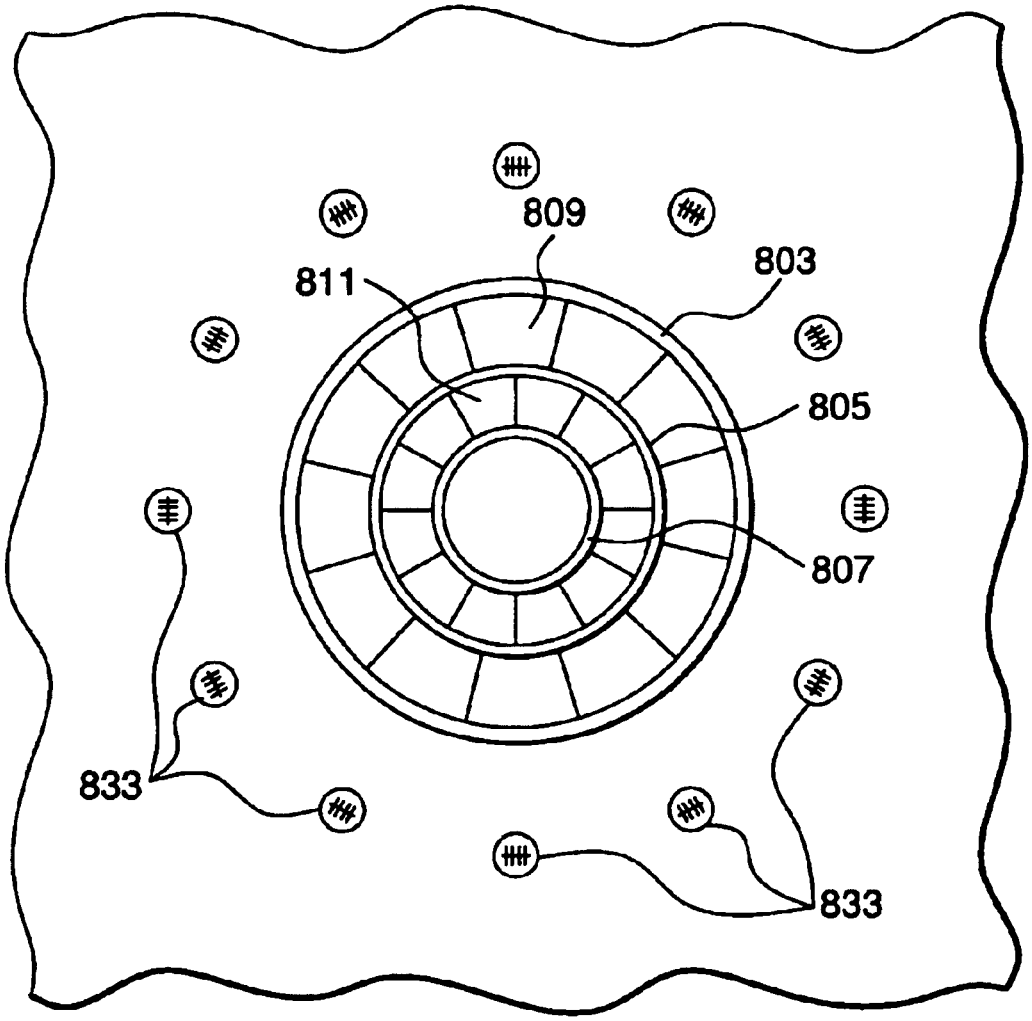
FIG. 9 is a schematic front view of the burner assembly of FIG. 8.

FIG. 9 is a plan view showing the discharge end of the exemplary apparatus of FIG. 8. Concentric pipes 803, 805, and 807 enclose annular spaces 809 and 811 which are fitted with radial members or fins. Slotted secondary fuel injection nozzles 833 (earlier described) may be disposed concentrically around the central burner as shown. In this embodiment, the slot angles of the slotted injection nozzles are oriented to direct injected secondary fuel in diverging directions relative to the axis of central burner 801.

Other types of slotted nozzles may be arrayed around the central burner for injecting secondary fuel. The nozzle bodies of these nozzles may utilize one or more slots extending through the nozzle body from the inlet face to the outlet face, and each of these slots may be characterized by a slot axis and a slot center plane as defined earlier. Each secondary fuel injector nozzle may have two or more slots and the slot axes of at least two slots may not be not parallel to each other. Alternatively, each secondary fuel injector nozzle may have two or more slots and at least two of the slots may intersect each other.

EXAMPLE

Figure 10A:
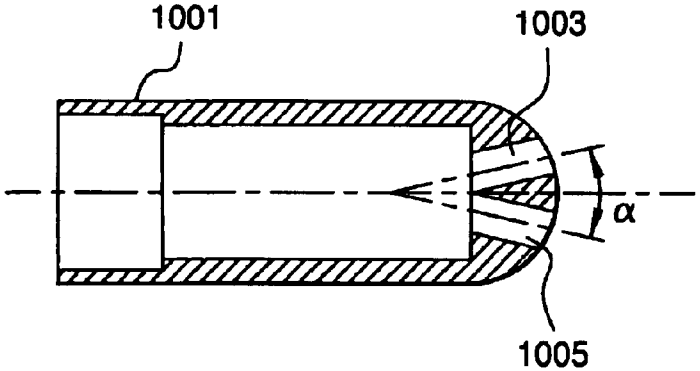
FIGS. 10A to 10C show representative top and side sectional views and a front view of a burner staging nozzle with circular injector holes.
Figure 10B:
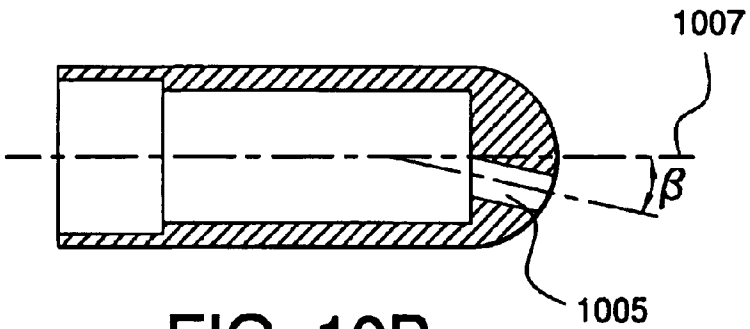
Figure 10C:
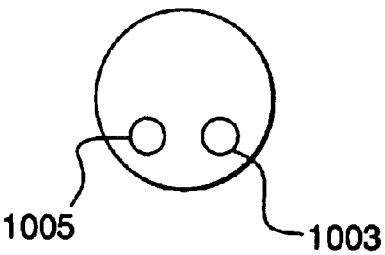

A combustion test furnace utilizing the burner assembly of FIGS. 8 and 9 was operated to compare the performance of the nozzles of FIGS. 1 and 4 with a circular nozzle configuration illustrated in FIGS. 10A, 10B, and 10C. These nozzles may be defined as staging nozzles which deliver secondary fuel to a second stage of combustion, wherein the fuel for the first stage of combustion is provided by fuel 815 via pipe 813 of FIG. 8.

The test furnace was 6 ft by 6 ft in cross-section and 17 ft long, had a burner firing at one end, and had an outlet for the combustion products at the other end. The outlet was connected to a stack fitted with a damper for furnace pressure control. The interior of the furnace was lined with high-temperature refractory and had water-cooled panels to simulate furnace load. The test burner was fired in the range of 3 to 6 MMBTU/hr using natural gas for the primary fuel and the secondary (staging) fuel. The flow rate of natural gas was varied between 3000 SCFH and 6000 SCFH. The preferred flow of primary fuel was set at 500 SCFH (8 to 16% of the total fuel) for 3 to 6 MMBTU/hr total firing rate.

The specific purposes of the tests were to determine fuel supply pressure requirements for optimum $NO_x$ performance from various nozzle shapes at various firing rates and to determe optimum $NO_x$ levels for these nozzles at different firing rates. The nozzle flow areas were gradually increased during various experiments for burners defined as "cross" and "zipper" nozzles (see below) to enable low fuel supply pressure operation and still obtain optimum $NO_x$ emissions.

FIG. 10A is a top sectional view of circular nozzle 1001 using two angled discharge holes 1003 and 1005 having circular cross sections. The hole diameter was 0.11 inch and the radial angle $\alpha$ between the holes was 15 degrees. FIG. 10B shows a side sectional view of the nozzle showing the axial angle $\beta$ between holes 1003 and 1005 and inlet flow axis 1007 wherein the angle $\beta$ was 7 degrees. FIG. 10C is a front view of the nozzle showing holes 1003 and 1005.

Figure 12:
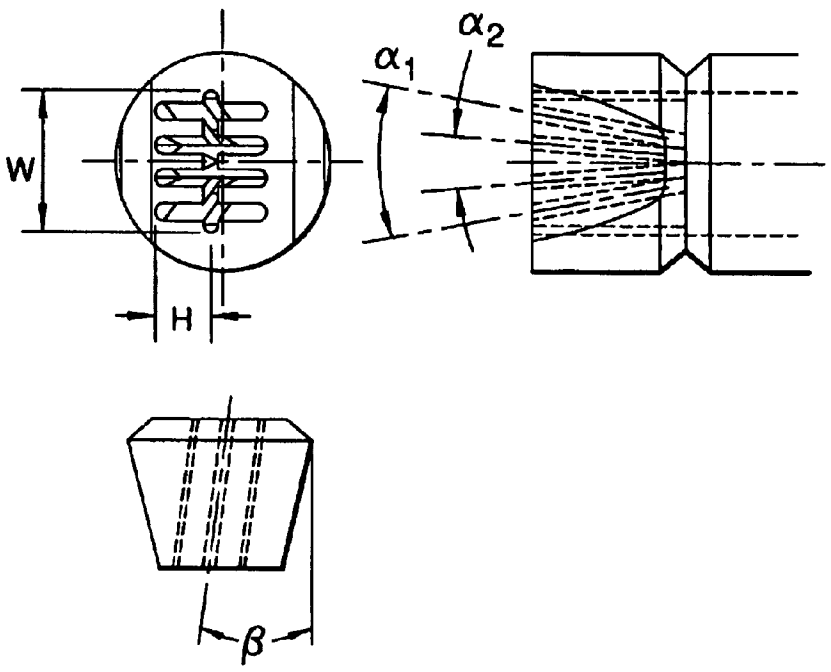
FIG. 12 shows typical dimensions of the nozzle of FIGS. 1, 2, 3A, 3B, 3C, and 3D.
Figure 11:
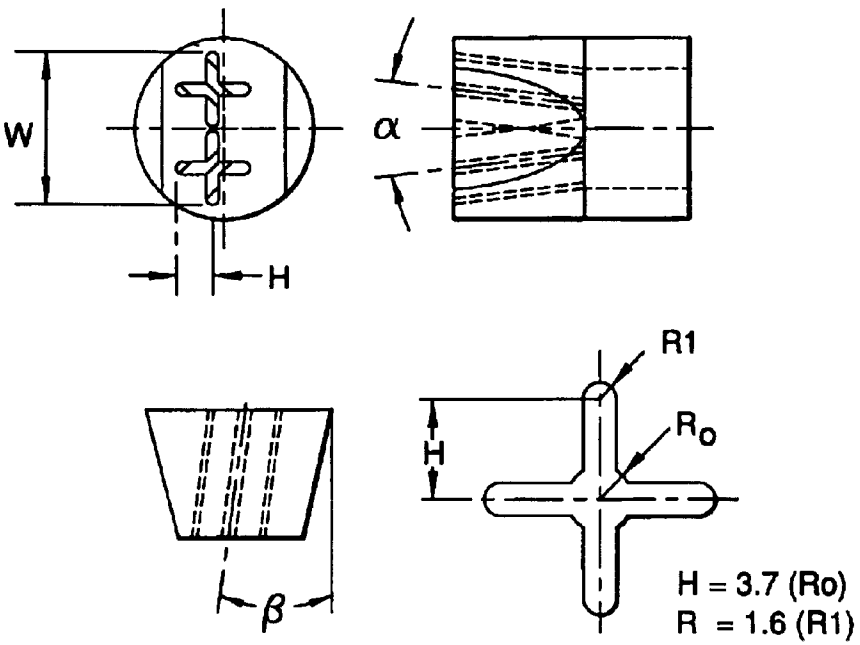
FIG. 11 shows typical dimensions of the nozzle of FIGS. 4, 5A, 5B, and 5C.

FIG. 11 shows views of the nozzle of FIGS. 5A, 5B, and 5C (described herein as a "cross" nozzle) and includes notation for dimensions and slot angles. FIG. 12 shows views of the nozzle of FIGS. 3A, 3B, 3C, and 3D (described herein as a "zipper" nozzle) and includes notation for dimensions and slot angles. The dimensions and angles for the nozzles used in the test furnace of this Example are given in Table 1. Typical ranges for these dimensions and angles are given in Table 2.

TABLE 1

Dimensions for Nozzles Used in Test Furnace

| Fuel Staging Nozzle Type | (H) Slot Height, (Inch) | (W) Slot Width, (Inch) | (Ro/R1) Slot end radius to center radius ratio | (H/Ro) Slot height to corner radius ratio | (α, α1, α2) Axial divergence angle, degrees | (β) Radial divergence angle, degrees |
|---|---|---|---|---|---|---|
| Cross Nozzle (FIG. 11) | 1/32 to 1 | 1/4 to 2 | 1.6 | 3.7 | 15 | 7 |
| Zipper Nozzle (FIG. 12) | 1/32 to 1 | 1/4 to 2 | 1.6 | 3.7 | 15 | 7 |

TABLE 2

Typical Ranges for Nozzle Dimensions

| Secondary Fuel Nozzle Type | (H) Slot Height, (Inch) | (W) Slot Width, (Inch) | (Ro/R1) Slot end radius to center radius ratio | (H/Ro) Slot height to corner radius ratio | (α, α1, α2) Axial divergence angle, degrees | (β) Radial divergence angle, degrees |
|---|---|---|---|---|---|---|
| Cross Nozzle (FIG. 11) | (1/32–1) | (1/4–2) | (1–3) | (2–6) | (0–30) | (0–30 |
| Zipper Nozzle (FIG. 12) | (1/32–1) | (1/4–2) | (1–3) | (2–6) | (0–30) | (0–30) |

The circular nozzle openings were drilled using standard twist drills whereas the cross and zipper nozzles openings were machined using Electro Discharge Machining (EDM). The main advantages of EDM are the ability to machine complex nozzle shapes, incorporate compound injection angles, provide higher dimensional accuracy, allow nozzle-to-nozzle consistency, and maintaining closer tolerances. However, there are alternate manufacturing methods, such as high energy laser cutting, that can also produce equivalent nozzle hole quality as the EDM method.

The test furnace was operated using each of the circular, cross, and zipper nozzle types for secondary or staged firing to investigate the effect of fuel pressure on firing rate and the effect of firing rate on $NO_x$ emissions in the furnace flue gas. The primary and secondary fuels were natural gas.

Figure 13:
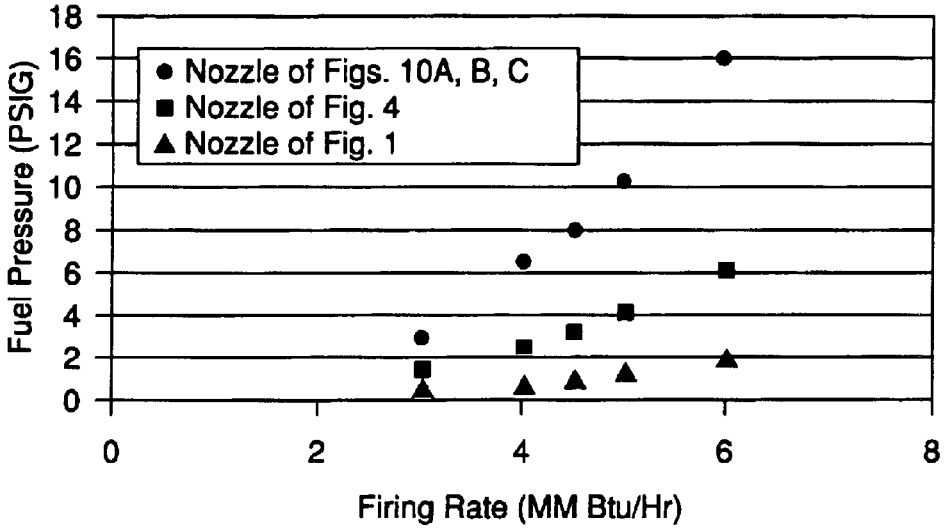
FIG. 13 is a plot of fuel pressure vs. firing rate for burner embodiments of the invention compared with the circular nozzle of FIGS. 10A to 10C.
Figure 14:
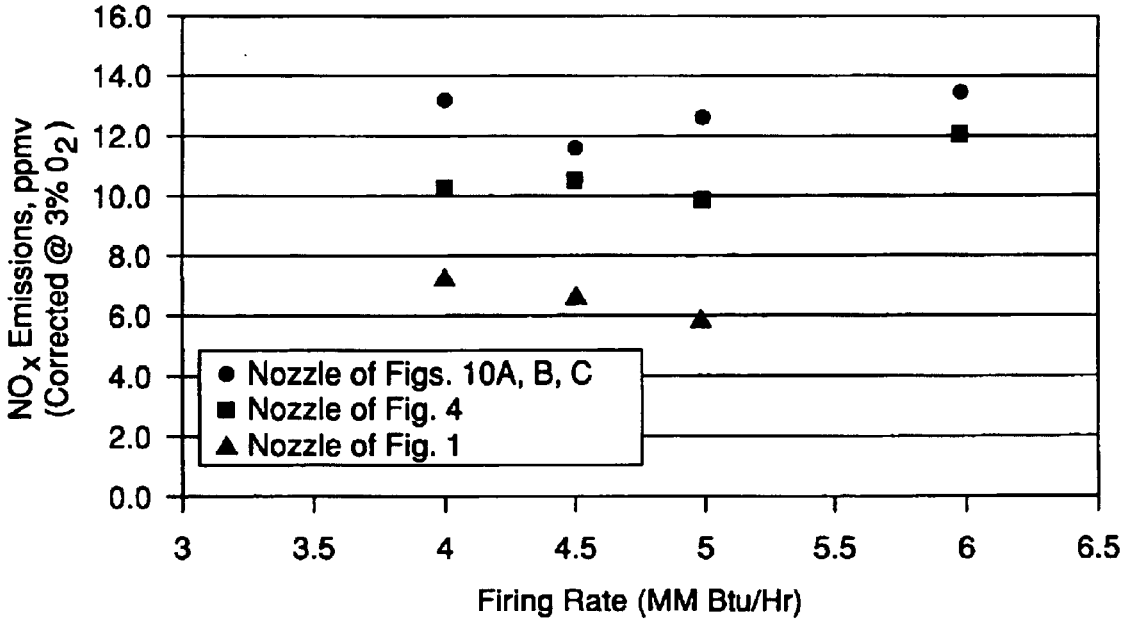
FIG. 14 is a plot of NOx emission concentration vs firing rate for burner embodiments of the invention compared with the circular nozzle of FIGS. 10A to 10C.

The test results are given in FIGS. 13 and 14. In FIG. 13, it is seen that the measured range of firing rates was achieved at the lowest fuel pressures for the zipper nozzle of FIG. 1 (triangular data points), at intermediate fuel pressures for the star nozzle of FIG. 4 (square data points), and at the highest fuel pressures for the circular nozzle of FIGS. 10A, B, and C (circular data points). The zipper nozzle of FIG. 1 therefore is the preferred nozzle for use in secondary fuel staging in burner systems of the type illustrated in FIGS. 8 and 9, particularly for fuel available only at the lowest pressures.

In FIG. 14, which is a plot of the $NO_x$ concentration in the test furnace flue gas discharge as a function of firing rate, it is seen that the lowest $NO_x$ concentrations were measured for the zipper nozzle of FIG. 1 (triangular data points). Higher $NO_x$ concentrations were measured for the star nozzle of FIG. 4 (square data points) and the highest $NO_x$ concentrations were measured for the circular nozzle of FIGS. 10A, B, and C (circular data points). These results indicate that the zipper nozzle operates at very low $NO_x$ emission levels and performs significantly better than the star and circular nozzles.

The cross- and zipper-shaped nozzles of the present invention operated at lower nozzle tip operating temperatures than the circular nozzle of FIGS. 10A, B, and C. It was observed during the laboratory experiments that the overall fuel supply pressure for the circular nozzle required increases to account for a lower nozzle flow coefficient as the nozzle operating temperatures increased above ambient. This was partly due to localized heating of the circular nozzle tips due to the fuel gas expansion effect at higher operating temperature. For this reason, the circular tip fuel supply pressure data required adjustment for higher operating temperature. The flow correction factor from ambient to the operating tip temperature (~450° F.) was about 0.58 for the circular nozzle, and this resulted in 42% less fuel flow due to the nozzle tip temperature.

In contrast, the zipper fuel nozzles have a relatively large exit flow area, and the nozzle tip was actively cooled by the exiting fuel gas stream. Unlike the circular nozzle, which has a relatively large stagnation region at the tip, the zipper nozzle has a much higher active cooling zone due to the number of narrow intersecting slots in the nozzle tip. The zipper nozzle required a smaller flow correction factor of 0.77 from ambient to operating the tip temperature (~250° F.), and thus required an approximately 33% lower fuel flow correction factor. This is significantly lower than the 450° F. temperature fuel flow correction factor required for the circular nozzles. Overall, the circular nozzles required a fuel supply pressure 5 times higher than the zipper nozzle for the same burner firing rate, probably due to relatively poor entrainment efficiency and higher operating tip temperature of the circular nozzle. The advantages of lower operating tip temperatures for the zipper or cross nozzles includes (a)

reduced tendency to coke when using higher carbon content fuels, (b) the ability to use smaller fuel flow rates or higher heating value fuels, and (c) the ability to use less expensive material for the nozzle material. Because of the operating tip temperature differences, type 304 or 310 stainless steel can be used for the zipper or cross nozzles while Hastelloy®, Inconel®, or other high-temperature alloys may be required for the circular nozzles.

Thermal cracking is a concern in many refinery furnace applications in which the fuel gas contains $C_1$ to $C_4$ hydrocarbons. The cracking of the heavier hydrocarbons, which occurs much more readily at the higher operating temperatures of circular nozzles, produces carbon that can plug burner nozzles, cause overheating of burner parts, reduce burner productivity, and result in poor thermal efficiency. The lower operating temperatures of the zipper and cross nozzles thus allows maintenance-free operation, and this is a critical operating advantage in the application of these burners in refinery furnace operations.

What is claimed is:

1. A burner assembly comprising:

(a) a central flame holder having inlet means for an oxidant gas, inlet means for a primary fuel, a combustion region for combusting the oxidant gas and the primary fuel, and an outlet for discharging a primary effluent from the flame holder; and (b) a plurality of secondary fuel injector nozzles surrounding the outlet of the central flame holder, wherein each secondary fuel injector nozzle comprises (1) a nozzle body having an inlet face, an outlet face, and an inlet flow axis passing through the inlet and outlet faces; and (2) one or more slots extending through the nozzle body from the inlet face to the outlet face, each slot having a slot axis and a slot center plane.

2. The burner assembly of claim 1 wherein each secondary fuel injector nozzle has two or more slots and the slot axes of at least two slots are not parallel to each other.

3. The burner assembly of claim 1 wherein each secondary fuel injector nozzle has two or more slots and at least two of the slots intersect each other.

4. The burner assembly of claim 3 wherein the nozzle body has four slots, wherein a first and a second slot intersect each other, and wherein a third and a fourth slot intersect each other.

5. The burner assembly of claim 3 wherein the nozzle body has three or more slots and a first slot is intersected by each of the other slots.

6. The burner assembly of claim 5 wherein the center plane of the first slot intersects the inlet flow axis at an included angle of between 0 and about 15 degrees.

7. The burner assembly of claim 5 wherein the center plane of any of the other slots intersects the inlet flow axis at an included angle of between 0 and about 30 degrees.

8. The burner assembly of claim 5 wherein the center planes of two adjacent other slots intersect at an included angle of between 0 and about 15 degrees.

9. The burner assembly of claim 8 wherein the two adjacent slots intersect at the inlet face of the nozzle body.

10. A combustion process comprising:

(a) providing burner assembly including:

(1) a central flame holder having inlet means for an oxidant gas, inlet means for a primary fuel, a combustion region for combusting the oxidant gas and the primary fuel, and an outlet for discharging a primary effluent from the flame holder; and (2) a plurality of secondary fuel injector nozzles surrounding the outlet of the central flame holder, wherein each secondary fuel injector nozzle comprises (2a) a nozzle body having an inlet face, an outlet face, and an inlet flow axis passing through the inlet and outlet faces; and (2b) one or more slots extending through the nozzle body from the inlet face to the outlet face, each slot having a slot axis and a slot center plane;

(b) introducing the primary fuel and the oxidant gas into the central flame holder, combusting the primary fuel with a portion of the oxidant gas in the combustion region of the flame holder, and discharging a primary effluent containing combustion products and excess oxidant gas from the outlet of the flame holder; and (c) injecting the secondary fuel through the secondary fuel injector nozzles into the primary effluent from the outlet of the flame holder and combusting the secondary fuel with excess oxidant gas.

11. The combustion process of claim 10 wherein the primary fuel and the secondary fuel are gases having different compositions.

12. The combustion process of claim 11 wherein the primary fuel is natural gas and the secondary fuel comprises hydrogen, methane, carbon monoxide, and carbon dioxide obtained from a pressure swing adsorption system.

13. The combustion process of claim 11 wherein the secondary fuel is introduced into the secondary fuel injector nozzles at a pressure of less than about 3 psig.

14. The combustion process of claim 10 wherein the primary fuel and the secondary fuel are gases having the same compositions.

* * * * *

UNITED STATES PATENT AND TRADEMARK OFFICE

CERTIFICATE OF CORRECTION

PATENT NO. : 6,866,503 B2
DATED : March 15, 2005
INVENTOR(S) : Mahendra Ladharam Joshi It is certified that error appears in the above-identified patent and that said Letters Patent is hereby corrected as shown below:

Title page,
Item [12], United States Patent, delete "Ladharam" and substitute therefore -- Joshi --
Item [75], Inventors, delete "Mahendra Ladharam" and substitute therefore
-- Mahendra Ladharam Joshi --

Signed and Sealed this

Seventh Day of June, 2005

JON W. DUDAS
*Director of the United States Patent and Trademark Office*